US005390779A

United States Patent [19]

Spatafora

[11] Patent Number: 5,390,779

[45] Date of Patent: Feb. 21, 1995

[54] COMPACTING UNIT FOR GROUPS OF FLAT PRODUCTS ARRANGED SIDE BY SIDE ON EDGE

[75] Inventor: Mario Spatafora, Bologna, Italy

[73] Assignee: Azionaria Costruzioni Macchine Automatiche A.C.M.A. S.p.A., Bologna, Italy

[21] Appl. No.: 187,731

[22] Filed: Jan. 28, 1994

[30] Foreign Application Priority Data

Feb. 19, 1993 [IT] Italy ..... BO93 A 000054

[51] Int. Cl.[6] ..... B65G 47/26

[52] U.S. Cl. ..... 198/458; 53/439; 53/529

[58] Field of Search ..... 198/458; 53/438, 439, 53/529

[56] References Cited

U.S. PATENT DOCUMENTS 3,001,344 9/1961 Morton et al. ..... 53/529

5,251,740 10/1993 Spatafora et al. ..... 198/458

*Primary Examiner*—Joseph E. Valenza

*Attorney, Agent, or Firm*—Oblon, Spivak, McClelland, Maier & Neustadt

[57] ABSTRACT

A compacting unit for groups of flat products arranged side by side on edge, wherein the groups are transported on a conveyor, with the products in each group housed axially separate inside a transverse pocket moving with the conveyor, and are successively engaged by a compacting device featuring a pair of opposed compacting arms. Each compacting arm presents an operating end, and is operated cyclically so that, for each cycle, the operating end is aligned with a pocket of a group, travels with and penetrates inside the pocket, and moves along the pocket towards the operating end of the other arm so as to move the products in the respective group transversely into contact with one another.

6 Claims, 3 Drawing Sheets

46
45
41
43
52
53
47
49
50
51
60
56
54
58
65
64
62
66
59
61
67
57
69
64
48
68
70
71

1
8
2
3
9
7
4
5a
5
44
6
9
16
41
20
38
18
40
17
19
37
39
24
26
25
22
34
35
36
21
23
27
28
29
31
30
32
33
M

COMPACTING UNIT FOR GROUPS OF FLAT PRODUCTS ARRANGED SIDE BY SIDE ON EDGE

BACKGROUND OF THE INVENTION

The present invention relates to a compacting unit for groups of flat products arranged side by side on edge.

The present invention is especially suitable for use in the food industry and in particular for packing flat food products such as sweets, lozenges and similar, to which the following description refers purely by way of example.

U.S. Pat. No. 5,076,416 relates to a device for supplying an orderly succession of flat products, whereby the products, e.g. cylindrical sweets, laid "flat" and in random manner on a vibratory surface, are fed to a number of curved downfeed channels, each of which rotates the products substantially 90° into an "on edge" position, and feeds them one by one into respective pockets on a respective screw conveyor.

Each screw conveyor feeds the products forward transversely and deposits them successively and on edge on to an output conveyor extending beneath the output ends of the screw conveyors and comprising a conveyor belt with a succession of transverse pockets, each designed to receive a group of products arranged side by side and on edge. The conveyor belt travels beneath a number of guide rods parallel to the traveling direction of the output conveyor, and each pair of adjacent guide rods defines, along the output conveyor, a respective axial channel along which are fed successively all the products fed on to the output conveyor by a given screw conveyor. In other words, the screw conveyors are so timed in relation to the output conveyor as to feed a respective product into each pocket on the output conveyor, and the output ends of the screw conveyors are offset so that each screw conveyor always feeds its products into a given respective axial channel.

Downstream from the last screw conveyor, therefore, each pocket on the output conveyor contains a group of products arranged side by side on edge, aligned in a direction perpendicular to the traveling direction of the output conveyor, and separated in said perpendicular direction by the guide rods.

SUMMARY OF THE INVENTION

It is an object of the present invention to provide a product compacting device featuring an input conveyor similar to the output conveyor described above, and which provides in a straightforward, reliable manner for supplying a succession of compacted groups, each consisting of a number of transversely-contacting products for supply to a follow-up operating unit normally consisting of a wrapping line.

According to the present invention, there is provided a compacting unit for groups of flat products arranged side by side on edge along a first axis perpendicular to the products; the unit comprising conveyor means having a first and second portion and designed to feed said groups successively in a given direction perpendicular to the first axis; and a compacting device cooperating with said conveyor means; the conveyor means comprising a number of pocket means equally spaced in said direction and each designed to receive a respective said group; and spacing means extending along said first portion, for separating the products in each group along the first axis; characterized by the fact that the compacting device comprises two lever arms in turn comprising respective operating heads located at said second portion and designed to engage said products for compacting them against one another parallel to said first axis, the lever arms being designed to rotate about respective second axes located on either side of said conveyor means and substantially perpendicular to said traveling direction and said first axis; first actuating means for moving each second axis cyclically about a respective third axis parallel to the second axis; and second actuating means for rotating each lever arm about said respective second axis.

According to a preferred embodiment of the above unit, the first actuating means comprise crank means interposed between each third axis and the respective second axis; and first drive means for rotating the crank means about the respective third axis.

The first actuating means preferably also comprise cam means located along each said third axis between the respective first drive means and the respective crank means, for moving the crank means cyclically in a direction parallel to the respective third axis, and for moving the respective operating head to and from a lowered position selectively engaging said pocket means.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
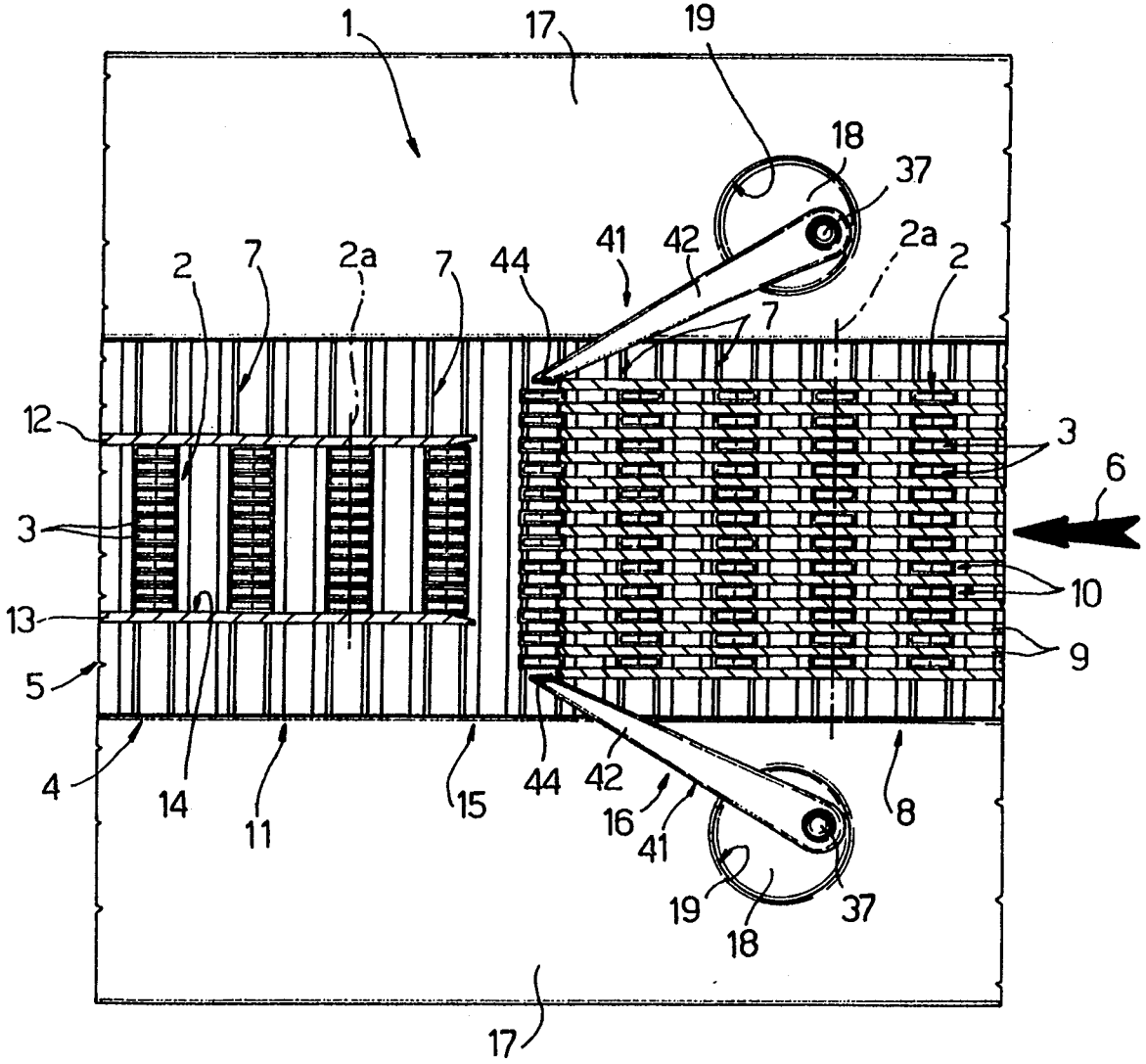
FIG. 1 shows a schematic plan view of a preferred embodiment of the compacting unit according to the present invention.
Figure 2:
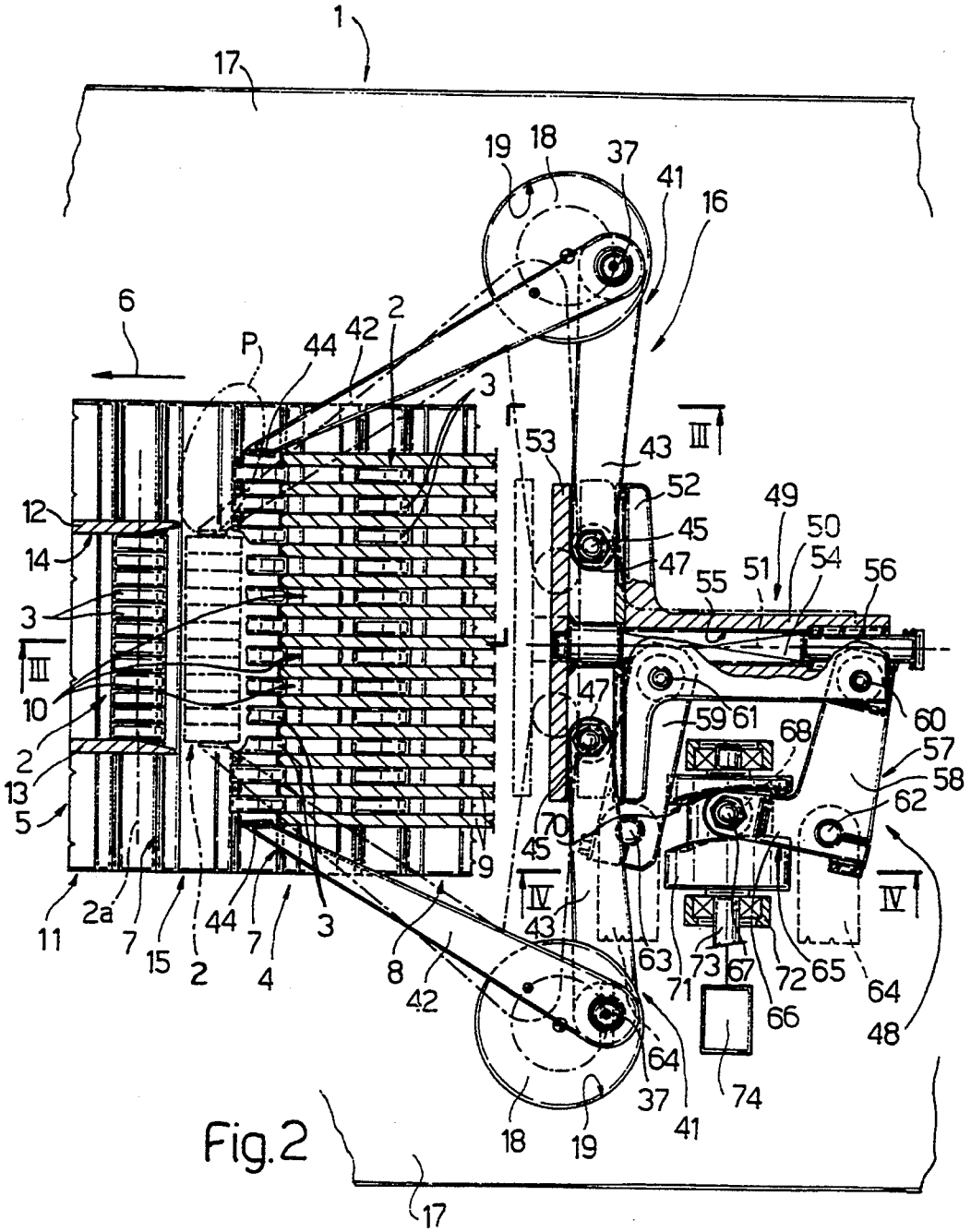
FIG. 2 shows a larger-scale, partially sectioned plan view, with parts removed for clarity, of a detail in FIG. 1.
Figure 4:
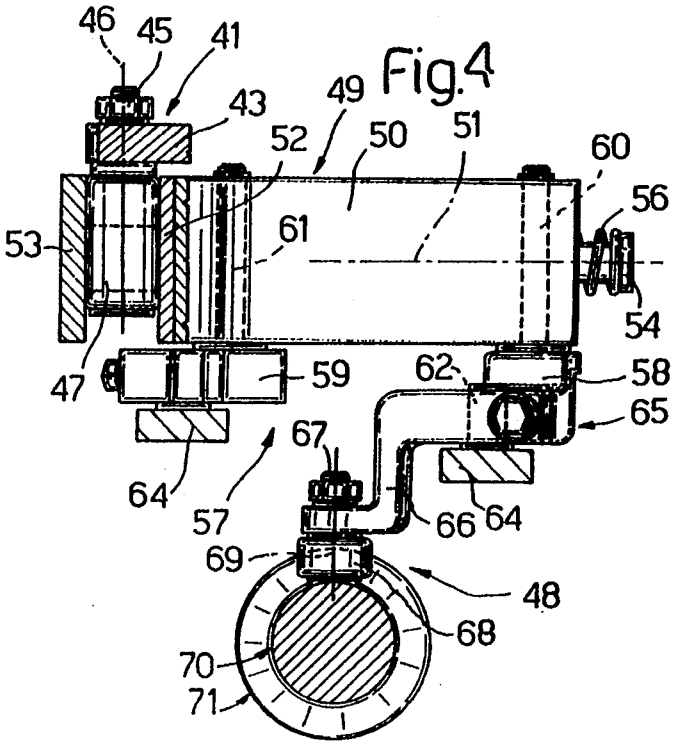
FIG. 4 shows a section along line IV—IV in FIG. 2.

Number 1 in FIGS. 1 and 2 indicates a compacting unit for groups 2 of flat products arranged side by side on edge and consisting, in the example shown, of cylindrical sweets 3.

Unit 1 comprises a conveyor 4, a substantially horizontal transportation branch 5 of which presents an upper surface 5*a* (FIG. 3) and travels, in use, at substantially constant speed in a substantially horizontal, axial direction 6. Externally, conveyor 4 presents a number of grooves or recesses 7, each extending perpendicular to direction 6 and defining, on branch 5 and through surface 5*a*, a pocket for receiving the bottom portion of sweets 3 of a given group 2, arranged side by side and on edge along a respective axis 2*a* perpendicular to direction 6.

Figure 3:
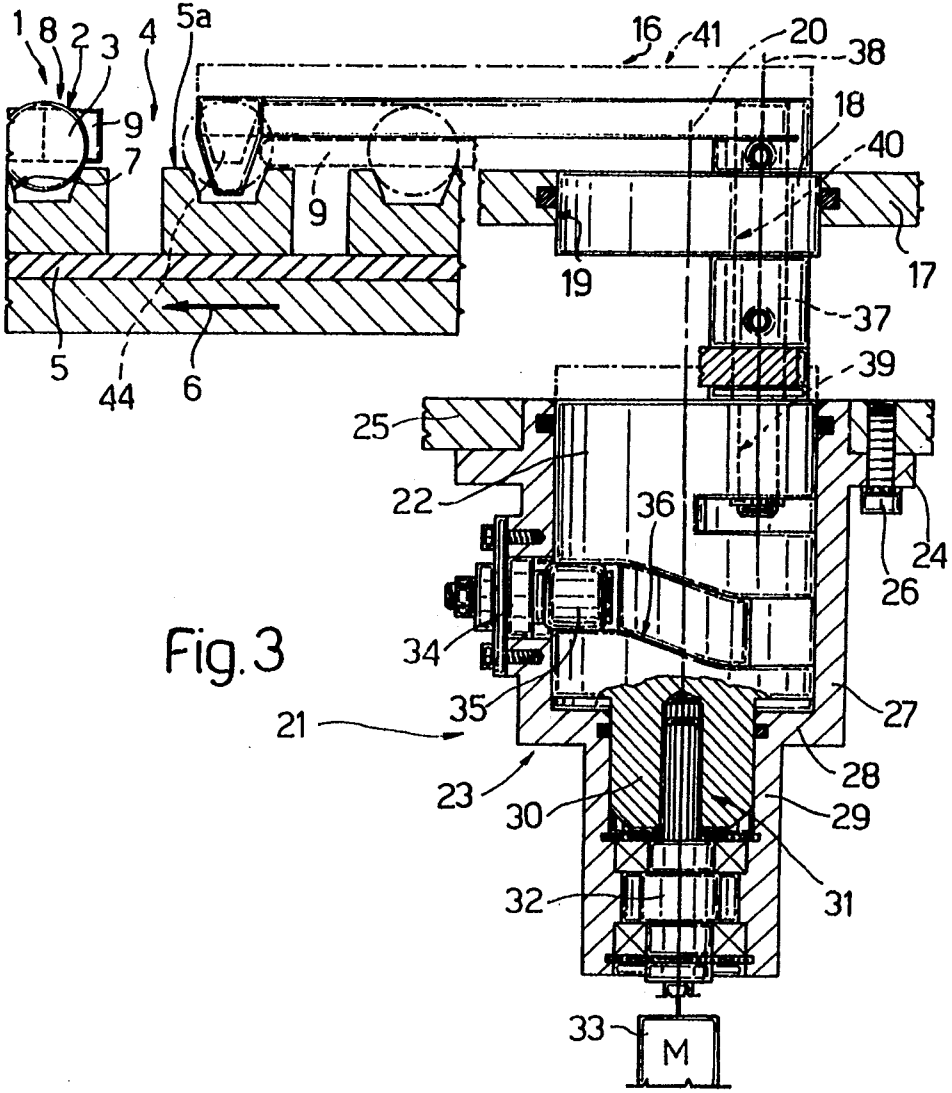
FIG. 3 shows a section along line III—III in FIG. 2.

As shown particularly in FIGS. 2 and 3, branch 5 of conveyor 4 comprises an input portion 8 along which branch 5 extends beneath a number of guide walls or rods 9 parallel to direction 6 and defining a number of longitudinal channels 10 equal in number to the sweets 3 in each group 2. In use, each sweet 3 travels in direction 6 along input portion 8 of conveyor 4 and respective channel 10 with its bottom portion engaged inside a respective recess 7, and is maintained in a substantially vertical "on edge" position perpendicular to the plane of branch 5 and parallel to direction 6 by the two rods 9 defining respective channel 10 and which provide for separating it from the adjacent sweets 3.

Branch 5 of conveyor 4 also comprises an output portion 11 at which branch 5 is located beneath two substantially vertical walls 12 and 13 extending parallel to direction 6 and defining a longitudinal channel 14, the width of which is approximately equal to but no less than the total thickness of sweets 3 in each group 2.

Finally, branch 5 of conveyor 4 also comprises an intermediate portion 15 connecting input and output portions 8 and 11, and the length of which is substantially equal to twice the center distance of adjacent recesses 7.

At intermediate portion 15, branch 5 of conveyor 4 cooperates with a compacting device 16 supported on two longitudinal plates 17 parallel to and substantially coplanar with surface 5*a* and extending on either side of branch 5 in direction 6.

As shown particularly in FIGS. 2 and 3, for each plate 17, device 16 comprises a crank consisting of a cylindrical plate 18 mounted in rotary and axially-sliding manner inside a cylindrical through hole 19 in plate 17, so as to move along a substantially vertical axis 20 perpendicular to surface 5*a*, and to rotate about axis 20 by virtue of an actuating device indicated as a whole by 21.

As shown in FIG. 3, each device 21 comprises a cylindrical drum 22 coaxial with axis 20, located beneath respective plate 18, and housed in sliding and rotary manner inside a cup-shaped body 23, the open end of which is positioned upwards facing the bottom end of plate 18, and presents an outer flange 24 fitted to a fixed frame 25 by means of screws 26. Body 23 presents a cylindrical lateral wall 27 closed at the bottom by a substantially horizontal bottom wall 28 having a tubular axial appendix 29 extending downwards from wall 28 and housing in rotary and axially-sliding manner a cylindrical appendix 30 coaxial with axis 20 and extending downwards from the bottom end of drum 22. By means of a splined coupling 31, appendix 30 is connected angularly but in axially-movable manner to the top end of the output shaft 32 of a motor 33 which provides for rotating drum 22 about axis 20 and is timed with motor 33 of the other device 21 via known timing means (not shown).

Device 21 also comprises a pin 34 fitted radially through wall 27 and supporting an idle tappet roller 35 projecting inside body 23 and engaging a cam groove 36 on the outer lateral surface of drum 22 for moving drum 22 axially back and forth along axis 20 as it is rotated by motor 33 about axis 20.

Device 21 is connected to respective plate 18 by a drive member defined by a pin 37 having an axis 38 parallel to and eccentric in relation to axis 20. Pin 37 presents a bottom end portion mounted in rotary and axially-fixed manner through an eccentric axial seat 39 formed through a top portion of drum 22; and a top end portion mounted in rotary and axially-fixed manner through an eccentric hole 40 formed through plate 18 and coaxial with axis 38.

Pin 37 constitutes the pivot of a respective rocker arm 41 comprising two substantially straight arms 42 and 43 forming an acute angle. Arm 42 is a compacting arm fitted to pin 37 on top of respective plate 17 and having an operating head 44 at the end; while arm 43 is a control arm fitted to pin 37 underneath respective plate 17.

Arms 42 of rocker arms 41 are substantially oriented towards output portion 11 of branch 5 of conveyor 4, with heads 44 facing each other at intermediate portion 15 of branch 5. Arms 43 on the other hand are oriented towards each other beneath branch 5, and present, on their free ends, respective pins 45 having respective axes 46 parallel to axis 20, and supporting respective idle rollers 47 connecting rocker arms 41 to an actuating device 48 for rotating rocker arms 41 equally and in opposite directions about respective axes 38.

As shown particularly in FIG. 2, device 48 presents an output member 49 comprising a tubular body 50 extending along a substantially horizontal axis 51 parallel to direction 6, and located beneath input portion 8 of branch 5 of conveyor 4. On the end facing intermediate portion 15 of branch 5, tubular body 50 presents an annular outer flange 52 facing the annular outer flange 53 of a pin 54 fitted in sliding manner inside a hole 55 in tubular body 50. An end portion of pin 54 projects from tubular body 50, and is connected to tubular body 50 via the interposition of a helical spring 56 for drawing flange 53 towards flange 52 and elastically gripping rollers 47 inside the gap defined between flanges 52 and 53. Tubular body 50 constitutes the connecting rod of an articulated parallelogram 57 comprising two cranks 58, 59 pivoting at one end on tubular body 50 by means of respective pins 60, 61 parallel to axis 20, and at the other end on a fixed frame, defined by two fixed, substantially horizontal brackets 64, by means of respective pins 62, 63. Crank 58 constitutes a first arm of a substantially L-shaped rocker arm 65, the second arm 66 of which is fitted on its free end with a pin 67 supporting an idle roller 68 with its axis 69 parallel to axis 20. Roller 68 engages a cam groove 70 formed on the outer cylindrical surface of a drum 71 supported for rotation on a fixed frame 72 and fitted to the output shaft 73—substantially horizontal and perpendicular to direction 6—of a motor 74. Motor 74 is synchronized in known manner (not shown) with motors 33, for moving tubular body 50 substantially back and forth in a direction parallel to axis 51 and to direction 6.

From the foregoing description it therefore follows that, if motors 33 and hence the two pins 37 are maintained idle, operation of motor 74 of actuating device 48 provides for axially displacing output member 49 and so rotating rocker arms 41 in opposite directions about pins 37, so that heads 44 are moved towards each other in a substantially transverse direction in relation to the traveling direction 6 of branch 5 of conveyor 4.

Conversely, if rollers 47 are released by output member 49 and rocker arms 41 locked angularly about respective pins 37, operation of motors 33 of actuating devices 21 provides for rotating plates 18 which, by virtue of the eccentricity of pins 37, act as cranks for rotating the big ends of the respective connecting rods, consisting of heads 44 of arms 41, along respective substantially circular paths.

In other words, by operating devices 21 and 48 simultaneously, it is possible to move heads 44 along respective substantially elliptical paths P, the longer axes of which are substantially transverse in relation to direction 6. In any case, the length and shape and the inclination of the longer axis in relation to direction 6 of each of paths P may be adjusted as required by means of actuating device 48.

From the foregoing description it also follows that, by means of cam groove 36, it is possible to move heads 44 vertically between a raised position (shown by the dotted line in FIG. 3) over surface 5*a*, and a lowered position (shown by the continuous line in FIG. 3)

wherein heads 44 are positioned just over the bottom of recesses 7.

In other words, by so setting the speeds of motors 33 that the speed of pins 37 is substantially equal to the traveling speed of branch 5 of conveyor 4, and the motion imparted by pins 37 to heads 44 in direction 6 is substantially equal, at least for a given distance, to the traveling speed of branch 5 of conveyor 4, and by operating motor 74 at the same speed as motors 33, it is possible, by appropriately designing and timing grooves 36 and 70, to move heads 44 along paths P in such a manner that:

- as sweets 3 in a group 2 approach the output end of respective channels 10, heads 44 begin to move in direction 6 and over surface 5*a;*
- as sweets 3 in said group 2 begin to exit respective channels 10, the speed of said movement of heads 44 equals the traveling speed of branch 5, and heads 44 are positioned over recess 7 housing group 2;
- before sweets 3 actually leave respective channels 10, heads 44, moving in direction 6 at the same speed as branch 5, move down into said recess 7 and towards each other so as to contact the two end sweets 3;
- as sweets 3 actually leave channels 10, heads 44, still moving in direction 6 at the same speed as branch 5, are brought further together and into line with the facing surfaces of walls 12 and 13, thus compacting group 2 and bringing sweets 3 into contact with one another;
- as sweets 3 begin to engage channel 14, heads 44 are raised clear of recess 7 and start moving back.

I claim:

1. A compacting unit (1) for groups (2) of flat products (3) arranged side by side on edge along a first axis (2*a*) perpendicular to the products (3); the unit (1) comprising conveyor means (4) having a first (8) and second (15) portion and designed to feed said groups (2) successively in a given direction (6) perpendicular to the first axis (2*a*); and a compacting device (16) cooperating with said conveyor means (4); the conveyor means (4) comprising a number of pocket means (7) equally spaced in said direction (6) and each designed to receive a respective said group (2); and spacing means (9) extending along said first portion (8), for separating the products (3) in each group (2) along the first axis (2*a*); characterized by the fact that the compacting device (16) comprises two lever arms (42) in turn comprising respective operating heads (44) located at said second portion (15) and designed to engage said products (3) for compacting them against one another parallel to said first axis (2*a*), the lever arms (42) being designed to rotate about respective second axes (38) located on either side of said conveyor means (4) and substantially perpendicular to said traveling direction (6) and said first axis (2*a*); first actuating means (21) for moving each second axis (38) cyclically about a respective third axis (20) parallel to the second axis (38); and second actuating means (48) for rotating each lever arm (42) about said respective second axis (38).

2. A unit as claimed in claim 1, characterized by the fact that the first actuating-means (21) comprise crank means (18) interposed between each third axis (20) and the respective second axis (38); and first drive means (33) for rotating the crank means (18) about the respective third axis (20).

3. A unit as claimed in claim 2, characterized by the fact that the first actuating means (21) also comprise cam means (36) located along each said third axis (20) between the respective first drive means (33) and the respective crank means (18), for moving the crank means (18) cyclically in a direction parallel to the respective third axis (20), and for moving the respective operating head (44) to and from a lowered position selectively engaging said pocket means (7).

4. A unit as claimed in claim 1, characterized by the fact that each said lever arm (42) constitutes a first arm (42) of a respective rocker arm (41) pivoting on the respective second axis (38) and comprising a second arm (43); said second actuating means (48) being connected to said second arm (43).

5. A unit as claimed in claim 4, characterized by the fact that said second arms (43) are oriented towards each other; the second actuating means (48) comprising an output member (49) connected to both the second arms (43); and second drive means (74) for moving the output member (49) back and forth in a direction substantially parallel to said traveling direction (6).

6. A unit as claimed in claim. 5, characterized by the fact that said output member (49) comprises guide means (52, 53) parallel to said first axis (2*a*) and connected in sliding manner to one end of each said second arm (43).

* * * * *